United States Patent [19]

Leikhim et al.

[11] 4,178,254

[45] Dec. 11, 1979

[54] FABRIC CARE COMPOSITIONS CONTAINING SMECTITE CLAY AND STARCH

[75] Inventors: John W. Leikhim, Cincinnati; Sharon J. Mitchell, Forest Park, both of Ohio

[73] Assignee: The Procter & Gamble Company, Cincinnati, Ohio

[21] Appl. No.: 885,933

[22] Filed: Mar. 13, 1978

[51] Int. Cl.[2] ..... D06M 13/00

[52] U.S. Cl. ..... 252/8.6; 8/115.6; 252/8.8

[58] Field of Search ..... 252/8.6, 8.8; 8/115.6

[56] References Cited

U.S. PATENT DOCUMENTS

| | | | |
|---|---|---|---|
| 2,826,506 | 3/1958 | Trusler | 252/8.6 UX |
| 3,892,681 | 7/1975 | Edwards et al. | 252/8.6 |
| 3,896,033 | 11/1975 | Grimm | 252/8.6 |
| 3,936,537 | 2/1976 | Baskerville et al. | 252/8.8 |
| 3,989,631 | 11/1976 | Marsan | 252/8.6 |
| 4,035,307 | 7/1977 | Fry et al. | 252/8.8 |

*Primary Examiner*—William E. Schulz

*Attorney, Agent, or Firm*—Edmund F. Gebhardt; Thomas H. O'Flaherty; Richard C. Witte

[57] ABSTRACT

Fabric care compositions are described containing a combination of smectite clay fabric softeners and a gelatinized starch sizing material. The compositions provide a desirable firm, crisp structure with a soft surface to fabrics treated in water dispersions of the composition.

10 Claims, No Drawings

FABRIC CARE COMPOSITIONS CONTAINING SMECTITE CLAY AND STARCH

BACKGROUND OF THE INVENTION

This invention relates to compositions adapted to provide a desirable texture to fabrics. The compositions may be used in the washing step or the rinsing step of a laundry procedure as well as a separate treatment in the manner of a conventional sizing agent. Compositions are particularly useful when used in conjunction with the washing procedure desribed in the co-pending commonly assigned patent application of Rodney M. Wise and Sharon J. Mitchell (U.S. Ser. No. 839,221, filed Oct. 3, 1977) incorporated herein by reference. This washing procedure involves the use of mixtures of water insoluble solvents and solvent soluble emulsifiers in aqueous washing media followed by treatment with compositions incorporating a surface active agent to remove residual solvent from the fabrics. The compositions of the present invention may optionally contain surface active agents and thereby function as solvent stripping agents as well as providing fabric care benefits.

The use of smectite clays as softening agents and the characteristics of the clays effective for such use is disclosed in U.S. Pat. No. 3,936,537 issued Feb. 3, 1976, incorporated herein by reference.

The starch utilized in the compositions of this invention is gelatinized vegetable starch.

The combination of kaolin clay and starch is known for its use as a filler for textiles and for the filling and coating of paper. Kaolin type clays do not provide a fabric softening effect and are not within the required characteristics of the smectite clays of the present invention.

It is an object of the present invention to provide fabric care compositions containing smectite clays and gelatinized vegetable starch.

A further object of the invention is to provide fabric care compositions adapted for use in a cleaning and fabric care procedure in which fabrics are exposed to washing media containing water insoluble solvents. These and other objects are obtained herein as will be seen by the following disclosure.

SUMMARY OF THE INVENTION

The present invention encompasses a fabric care composition suitable for providing or restoring body to fabrics comprising (a) from about ½% to about 75% of a smectite clay selected from the group consisting of alkali and alkaline earth metal montmorillonites, saponites and hectorites having an ion exchange capacity of at least about 50 meq. per 100 grams; (b) from about 1% to about 90% of a gelatinized vegetable starch; and (c) from 0% to about 98% water.

Vegetable starches suitable for use in the practice of this invention include cornstarch, wheat starch, rice starch and potato starch. Cornstarch is particularly suitable.

DETAILED DESCRIPTION OF THE INVENTION

The fabric compositions of this invention comprise two essential ingredients (1) a smectite clay and (2) a gelatinized vegetable starch.

The Clay

The smectite clays particularly useful in the practice of the present invention are sodium and calcium montmorillonites, sodium saponites, and sodium hectorites. Smectite clays are present in the compositions of this invention at levels from about ½% to about 75% by weight. Preferably liquid compositions contain from about ½% to about 15%, most preferably from about 1% to about 10%, by weight of clay while granular compositions contain from about 3% to about 75%, preferably from about 5% to about 60%, and most preferably from about 10% to about 40% by weight of clay. The clays used herein have a particle size which cannot be perceived tactilely. Impalpable clays have particle sizes below about 50 microns; the clays used herein have a particle size range of from about 5 microns to about 50 microns.

The clay minerals can be described as expandable, three-layer clays, i.e., alumino-silicates and magnesium silicates, having an ion exchange capacity of at least 50 meq/100 g. of clay and preferably at least 60 meq/100 g. of clay. The term "expandable" as used to describe clays relates to the ability of the layered clay structure to be swollen, or expanded, on contact with water. The three-layer expandable clays used herein are those materials classified geologically as smectites.

There are two distinct classes of smectite clays that can be broadly differentiated on the basis of the numbers of octahedral metal-oxygen arrangements in the central layer for a given number of silicon-oxygen atoms in the outer layers. The dioctahedral minerals are primarily trivalent metal ion-based clays and are comprised of the prototype pyrophyllite and the members montmorillonite $(OH)_4Si_{8-y}Al_y(Al_{4-x}Mg_x)O_{20}$, nontronite $(OH)_4Si_{8-y}Al_y(Al_{4-x}Fe_x)O_{20}$, and volchonskoite $(OH)_4Si_{8-y}Al_y(Al_{4-x}Cr_x)O_{20}$, where x has a value of from 0 to about 4.0 and y has a value of from 0 to about 2.0. Of these only montmorillonites having exchange capacities greater than 50 meq/100 g. are suitable for the present invention and provide fabric softening benefits.

The trioctahedral minerals are primarily divalent metal ion based and comprise the prototype talc and the members hectorite $(OH)_4Si_{8-y}Al_y(Mg_{6-x}Li_x)O_{20}$, saponite $(OH)_4(Si_{8-y}Al_y)(Mg_{6-x}Al_x)O_{20}$, sauconite $(OH)_4Si_{8-y}Al_y(Zn_{6-x}Al_x)O_{20}$, vermiculite $(OH)_4Si_{8-y}Al_y(Mg_{6-x}Fe_x)O_{20}$, wherein y has a value of 0 to about 2.0 and x has a value of 0 to about 6.0. Hectorite and saponite are the only minerals in this class that are of value in the present invention, the fabric softening performance being related to the type of exchangeable cation as well as to the exchange capacity. It is to be recognized that the range of the water of hydration in the above formulas can vary with the processing to which the clay has been subjected. This is immaterial to the use of the smectite clays in the present invention in that the expandable characteristics of the hydrated clays are dictated by the silicate lattice structure.

As noted hereinabove, the clays employed in the compositions of the instant invention contain cationic counterions such as protons, sodium ions, potassium ions, calcium ions, and lithium ions. It is customary to distinguish between clays on the basis of one cation predominantly or exclusively absorbed. For example, a sodium clay is one in which the absorbed cation is predominantly sodium. Such absorbed cations can become involved in exchange reactions with cations present in aqueous solutions. A typical exchange reaction involving a smectite-type clay is expressed by the following equation: smectite clay (Na)+⇄smectite clay $(NH_4)+NaOH$ Since the foregoing equilibrium reaction, one equivalent weight of ammonium ion replaces an equivalent weight of sodium, it is customary to measure cation exchange capacity (sometimes termed "base exchange capacity") in terms of milli-equivalents per 100 g. of clay (meq/100 g.). The cation exchange capacity of clays can be measured in several ways, including by electrodialysis, by exchange with ammonium ion followed by titration or by a methylene blue procedure, all as fully set forth in Grimshaw, "The Chemistry and Physics of Clays", pp. 264–265, Interscience (1971). The cation exchange capacity of a clay mineral relates to such factors as the expandable properties of the clay, the charge of the clay, which, in turn, is determined at least in part by the lattice structure, and the like. The ion exchange capacity of clays varies widely in the range from about 2 meq/100 g. of kaolinites to about 150 meq/100 g., and greater, for certain smectite clays. Illite clays although having a three layer structure, are of a non-expanding lattice type and have an ion exchange capacity somewhere in the lower portion of the range, i.e., around 26 meq/100 g. for an average illite clay. Attapulgites, another class of clay minerals, have a spicular (i.e. needle-like) crystalline form with a low cation exchange capacity (25–30 meq/100 g.). Their structure is composed of chains of silica tetrahedrons linked together by octahedral groups of oxygens and hydroxyls containing Al and Mg atoms.

It has been determined that illite, attapulgite, and kaolinite clays, with their relatively low ion exchange capacities, are not useful in the instant compositions. Indeed, illite and kaolinite clays constitute a major component of clay soils and, as noted above, are removed from fabric surfaces by means of the instant compositions. However the alkali metal montmorillonites, saponites, and hectorites, and certain alkaline earth metal varieties of these minerals such as calcium montmorillonites have been found to show useful fabric softening benefits when incorporated in compositions in accordance with the present invention.

Specific non-limiting examples of such fabric softening smectite clay minerals are:

Sodium Montmorillonite

Brock
Volclay BC
Gelwhite GP
Thixo-Jel #2
Ben-A-Gel

Sodium Hectorite

Veegum F
Laponite SP

Sodium Saponite

Barasym NAS 100

Calcium Montmorillonite

Soft Clark
Gelwhite L

Lithium Hectorite

Barasym LIH 200

Accordingly, smectite clays useful herein can be characterized as montmorillonite, hectorite, and saponite clay minerals having an ion exchange capacity of at least about 50 meq/100 g. and preferably at least 60 meq/100 g.

While not intending to be limited by theory, it appears that the advantageous softening (and potentially dye scavenging, etc.) benefits of the instant compositions are ascribable to the physical characteristics and ion exchange properties of the clay minerals used therein. Furthermore, the unique physical and electrochemical properties of the smectite clays apparently cause their interaction with, and dispersion by, any poly-anionic builder salts which may by used. Most of the smectite clays useful in the compositions herein are commercially available under various tradenames, for example, Thixo-Jel #1, Thixo-Jel #2, and Gelwhite GP from Georgia Kaolin Co., Elizabeth, N.J.; Volclay BC and Volclay #325, from American Colloid Co., Skokie, Ill.; and Veegum F, from R. T. Vanderbilt. It is to be recognized that such smectite minerals obtained under the foregoing tradenames can comprise mixtures of the various discrete mineral entities. Such mixtures of the smectite minerals are suitable for use herein.

Within the classes of montmorillonite, hectorite, and saponite clay minerals having a cation exchange capacity of at least about 50 meq/100 g, certain clays are preferred for fabric softening purposes. For example, Gelwhite GP is an extremely white form of smectite clay and is therefore preferred when formulating white granular detergent compositions. Volclay BC, which is a smectite clay mineral containing at least 3% of iron (expressed as $Fe_2O_3$) in the crystal lattice, and which has a very high ion exchange capacity, is one of the most efficient and effective clays for use in laundry compositions and is preferred from the standpoint of product performance. On the other hand, certain smectite clays marketed under the name "bentonite" are sufficiently contaminated by other silicate minerals, as evidenced by a low colloid content ($\approx$50%) that their ion exchange capacity falls below the requisite range, and such clays are of no use in the instant compositions.

Bentonite, in fact, is a rock type originating from volcanic ash and contains montmorillonite (one of the smectite clays) as its principal clay component. The Table shows that materials commercially available under the name bentonite can have a wide range of cation exchange capacities and fabric softening performance.

| BENTONITE | SUPPLIER | EXCHANGE CAPACITY meq/100 g | SOFTENING ABILITY |
|---|---|---|---|
| Brock | Georgia Kaolin Co. U.S.A. | 63 | Good |
| Soft Clark | Georgia Kaolin Co. U.S.A. | 84 | Good |
| Bentolite L | Georgia Kaolin Co. U.S.A. | 68 | Fair–Good |
| Clarolite T-60 | Georgia Kaolin Co. U.S.A. | 61 | Fair |
| Granulare Naturale Bianco | Seven C. Milan Italy | 23 | Fair–Poor |
| Thixo-Jel #4 | Georgia Kaolin Co. U.S.A. | 55 | Poor* |
| Granular Naturale Normale | Seven C. Milan Italy | 19 | Poor |
| Clarsol FB 5 | Ceca Paris France | 12 | Poor |

-continued

| BENTONITE | SUPPLIER | EXCHANGE CAPACITY meq/100 g | SOFTENING ABILITY |
|---|---|---|---|
| PDL 1740 | Georgia Kaolin Co. U.S.A. | 26 | None |
| Versuchs Product FFI | Süd-Chemie Munich Germany | 26 | None |

*Low colloid content (≈50%)

Appropriate clay minerals for use herein can be selected by virtue of the fact that smectites exhibit a true 14Å x-ray diffraction pattern. This characteristic pattern, taken in combination with exchange capacity measurements performed in the manner noted above, provides a basis for selecting particular smectite-type minerals for use in the compositions disclosed herein.

The smectite clay materials useful in the present invention are hydrophilic in nature, i.e. they display swelling characteristics in aqueous media. Conversely they do not swell in nonaqueous or predominantly nonaqueous systems.

The Starch

Starch derived from plant sources is generally a mixture of 15% to 40% linear chain amylose and 60% to 85% branched chain amylopectin. In raw form, plant derived starch is in minute water-insoluble granules that range in size from about 4 to 8 microns for rice to 15 to 100 microns for potato. Corn starch granules are generally in a 10 to 25 micron range. When water suspensions of vegetable starch granules are heated to progressively higher temperatures, nothing substantial occurs until a critical gelatinization temperature is reached, specific to the species of starch. At this temperature the granules swell, lose polarization crosses, and irreversibly lose anisotropy. Potato starch gelatinizes in the range of 56°-67° C., corn starch in the range of 62°-72° C., and rice and sorgum in the range of 68°-78° C. After initial gelatinization, the starch granules continue to swell and the granules' structure is at least partially disrupted to produce the thick-bodied consistency of a cooked starch paste.

Gelatinized starch dispersions can be subject to stability problems of which retrogradation is particularly serious. In relatively concentrated dispersions, retrogradation results in a viscosity increase or gelling. In relatively dilute dispersions retrogradation can result in sedimentation. Retrogradation is attributed to molecular reassociation of amylose but dispersion viscosity is also a function of the extent of fragmentation of the swollen starch granules. Gelatinized but intact starch granules substantially contribute to dispersion viscosity. As described hereinafter, the liquid compositions preferably incorporate a stabilized starch.

In a liquid composition the starch is preferably used at a level of from about 1% to about 15%, most preferably from about 2% to about 10%, by weight of the compositions and in a solid composition the starch is preferably used at a level of from about 10% to about 60%, most preferably from about 20% to about 50%, by weight of the compositions.

The vegetable starches used in this invention include the so-called modified starches exemplified by starches treated with acid, enzymes or by oxidation or by addition of ether or ester groups. Modified starches generally provide relatively lower viscosity dispersions and are known as "thin boiling" starches. Pre-gelatinized modified starches can also be utilized, in which event no additional heating step is necessary.

Highly preferred for use in liquid compositions of the present invention stabilized are the aqueous starch dispersions produced by exposing an aqueous dispersion of a gelatinized starch to a pH of from about 10 to about 13, preferably from about 11 to about 12, and thereafter neutralizing any excess alkali to a resultant pH of from about 4 to about 9. If the starch has not previously been gelatinized, the starch should be held at a temperature above its gelatinization point for at least about 5 minutes prior to, or simultaneously with the exposure to said pH.

This stabilization process is disclosed in the concurrently filed U.S. patent application of Samuel M. Johnson, Ser. No. 885,925, entitled, FABRIC CARE COMPOSITIONS CONTAINING STARCH AND SURFACTANT, incorporated herein by reference.

Optional Ingredients

Ingredients not inconsistent with the stability or performance of the fabric care compositions of the invention can be incorporated.

The liquid fabric care compositions of this invention comprise from about 50% to about 98% water, preferably from about 65% to about 90% water, and most preferably from about 70% to about 85% water.

Compositions of the invention, particularly liquid compositions, can comprise up to about 20% of an electrolyte as a stability aid. This can be any suitable inorganic or organic ionizable compound such as salts or acids—e.g., alkali metal or alkaline earth metal chlorides, sulfates, carbonates, silicates, phosphates, acetates and citrates and certain hydrotropes described hereinafter. Preferably the electrolyte concentration in liquid compositions is from about 1% to about 10%. Sodium and potassium carbonates and bicarbonates are particularly preferred electrolytes.

Ethyl alcohol and other water-soluble organic solvents can be utilized at levels up to about 10%, preferably from about 1% to about 5%, to aid in the incorporation of the surface-active agents. Hydrotropes or blending agents such as urea, and sodium, potassium, ammonium, mono-, di- or triethanolammonium cumene sulfonate, benzene sulfonate, toluene sulfonate and xylene sulfonate and mixtures therefore can also find use to inhibit phase separation of the composition throughout a broad range of possible storage temperatures. Hydrotropes or blending agents can be used at levels up to about 8%, preferably from about 1% to about 6%.

Fabric softening and antistatic agents are particularly useful optional ingredients in the compositions of this invention as described in the copending application of Samuel M. Johnson and Emelyn L. Hiland, Ser. No. 885,937, filed concurrently herewith and incorporated herein by reference. Examples of fabric softening agents are cationic quaternary ammonium compounds such as ditallowdimethylammonium chloride. Cationic quaternary ammonium compounds can be used at levels up to about 8%, preferably from about .25% to 4%.

Surface-active detergents or "surfactants" selected from the group consisting of anionic, nonionic, zwitterionic and amphoteric surface-active detergents and mixtures thereof are useful in the compositions of this invention, particularly if the compositions are utilized as combination fabric care and solvent stripping agents as discussed hereinbefore.

Water soluble anionic surfactants suitable for use in the practice of this invention include the alkali metal, alkaline earth metal, ammonium, and substituted ammonium salts of organic sulfuric reaction products. Examples of salts of organic sulfuric reaction products are sodium alkyl sulfate and sodium alkyl benzene sulfonate wherein the alkyl group contains from about 10 to about 20 carbon atoms. Other preferred surfactants of this class are paraffin sulfonates and olefin sulfonates in which the alkyl or alkenyl group contains from about 10 to about 20 carbon atoms.

Other preferred water soluble anionic surfactants useful herein are alkyl ether sulfates having the formula $RO(C_2H_4O)_xSO_3M$ wherein R is alkyl or alkenyl of about 10 to about 20 carbon atoms, x is 1 to 30, and M is a water-soluble cation. The alkyl ether sulfates useful in the present invention are condensation products of ethylene oxide and monohydric alcohols having about 10 to about 20 carbon atoms. Preferably, R has 12 to 18 carbon atoms. The alcohols can be derived from natural fats, e.g., coconut oil or tallow, or can be synthetic. Such alcohols are reacted with 1 to 30, and especially 3, molar proportions of ethylene oxide and the resulting mixture of molecular species is sulfated and neutralized.

Specific examples of alkyl ether sulfates of the present invention are sodium coconut alkyl triethylene glycol ether sulfate, lithium tallow alkyl triethylene glycol ether sulfate, and sodium tallow alkyl hexaoxyethylene sulfate. Preferred alkyl ether sulfates are those comprising a mixture of individual compounds, said mixture having an average alkyl chain length of from about 12 to 16 carbon atoms and an average degree of ethoxylation of from about 1 to 4 moles of ethylene oxide.

Additional examples of anionic surfactants useful herein are the compounds which contain two anionic functional groups. These are referred to as di-anionic surfactants. Suitable dianionic surfactants are the disulfonates, disulfates, or mixtures thereof which may be represented by the following formula:

$$R(SO_3)_2M_2, R(SO_4)_2M_2, R(SO_3)(SO_4)M_2$$

where R is an acyclic aliphatic hydrocarbyl group having 15 to 20 carbon atoms and M is a water-solubilizing cation, for example, the $C_{15}$ to $C_{20}$ disodium 1,2-alkyldisulfates, $C_{15}$ to $C_{20}$ dipotassium-1,2-alkyldisulfonates or disulfates, disodium 1,9-hexadecyl disulfates, $C_{15}$ to $C_{20}$ disodium 1,2-alkyldisulfonates, disodium 1,9-stearyldisulfates and 6,10-octadecyldisulfates.

Water soluble nonionic surfactants having an HLB value of from about 11 to about 18 and useful herein include:

1. The polyethylene oxide condensates of alkyl phenols. These compounds include the condensation products of alkyl phenols having an alkyl group containing from about 6 to 12 carbon atoms in either a straight chain or branched chain configuration, with ethylene oxide, the said ethylene oxide being present in amounts equal to 3 to 25 moles of ethylene oxide per mole of alkyl phenol. The alkyl substituent in such compounds may be derived, for example, from polymerized propylene or isobutylene, octene or nonene. Examples of compounds of this type include nonyl phenol condensed with about 9.5 moles of ethylene oxide per mole of nonyl phenol and dodecyl phenol condensed with about 12 moles of ethylene oxide per mole of dodecyl phenol. Commercially available nonionic surfactants of this type include Igepal CO-610 marketed by the GAF Corporation, and Triton X-45, X-114, X-100 and X-102, all marketed by the Rohm and Haas Company.

2. The condensation products of aliphatic alcohols with from about 3 to about 70 moles of ethylene oxide. The alkyl chain of the aliphatic alcohol may either be straight or branched and generally contains from about 8 to about 22 carbon atoms. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above-described coconut alcohol. Examples of commercially available nonionic surfactants of this type include Tergitol 15-S-9 marketed by the Union Carbide Corporation, Neodol 23-6.5 marketed by the Shell Chemical Company.

3. The condensation products of ethylene oxide with a hydrophobic base formed by the condensation of propylene oxide with propylene glycol. The hydrophobic portion of these compounds has a molecular weight of from about 1500 to 1800 and exhibits water insolubility. The addition of at least about 30% and preferably less than about 90% by weight of polyoxyethylene moieties to this hydrophobic portion provides water-solubility to the molecule. Examples of compounds of this type include certain of the commercially available Pluronic surfactants marketed by the Wyandotte Chemicals Corporation.

4. The condensation products of ethylene oxide with the product resulting from the reaction of propylene oxide and ethylenediamine. The hydrophobic base of these products consists of the reaction product of ethylenediamine and excess propylene oxide, said base having a molecular weight of from about 2500 to about 3000. This base is condensed with ethylene oxide to the extent that the condensation product contains from about 40 to about 80% by weight of polyoxyethylene and has a molecular weight of from about 5,000 to about 11,000. Examples of this type of nonionic surfactant include certain of the commercially available Tetronic compounds marketed by the Wyandotte Chemicals Corporation.

5. Surfactants having the formula $R^1R^2R^3N \rightarrow O$ (amine oxide surfactants) wherein $R^1$ is an alkyl group containing from about 10 to about 18 carbon atoms, from 0 to about 2 hydroxy groups and from 0 to about 5 ether linkages, there being at least one moiety of $R^1$ which is an alkyl group containing from about 10 to about 18 carbon atoms and no ether linkages, and each $R^2$ and $R^3$ is selected from the group consisting of alkyl groups and hydroxyalkyl groups containing from 1 to about 3 carbon atoms. Specific examples of amine oxide surfactants include: dimethyldodecylamine oxide, dimethyltetradecylamine oxide, ethylmethyltetradecylamine oxide, cetyldimethylamine oxide, dimethylstearylamine oxide, cetylethylpropylamine oxide, diethyldodecylamine oxide, diethyltetradecylamine oxide, dipropyldodecylamine oxide, bis-(2-hydroxyethyl)dodecylamine oxide, bis(2-hydroxyethyl)-3-dodecoxy-2-hydroxypropylamine oxide, (2-hydroxypropyl)methyltetradecylamine oxide, dimethyloleylamine oxide, dimethyl-(2-hydroxydodecyl)amine oxide, and the corresponding decyl, hexadecyl and octadecyl homologs of the above compounds.

Amphoteric synthetic detergents can be broadly described as derivatives of aliphatic, or alkyl substituted hetero cyclic, secondary and tertiary amines in which the aliphatic radical may be straight chain or branched and wherein one of the aliphatic substituents contains from about 8 to 18 carbon atoms and at least one contains an anionic water-solubilizing group, e.g., carboxy, sulfonate, sulfate. Examples of compounds falling within this definition are sodium 3-(dodecylamino)propionate, sodium 2-(dodecylamino)ethyl sulfate, sodium 2-(dimethylamino)octadecanoate, disodium 3-(N-carboxymethyldodecylamino)propane-1-sulfonate, disodium octadecyl-iminodiacetate, sodium 1-carboxymethyl-2-undecylimidazole, and sodium N,N-bis(2-hydroxyethyl)-2-sulfato-3-dodecoxy-propylamine. Sodium 3-(dodecylamino)propane-1-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent attached to an "onium" atom and containing an anionic water-solubilizing group, e.g., carboxy, sulfonate, sulfate, phosphate, or phosphonate. Examples of zwitterionic surfactants include 3-(N,N-dimethyl-N-hexadecylammonio)-propane-1-sulfonate; 3-(N,N-dimethyl-N-hexadecylammonio)-2-hydroxypropane-1-sulfonate; N,N-dimethyl-N-dodecylammonio acetate; 3-(N,N-dimethyl-N-dodecylammonio)propionate; 2-(N,N-dimethyl-N-octadecylammonio)ethyl sulfate; 3-(P,P-dimethyl-P-dodecylphosphonio)propane-1-sulfonate; 2-(S-methyl-S-tert-hexadecylsulfo)ethane-1-sulfonate; 3-(S-methyl-S-dodecylsulfonio)propionate; N,N-bis(oleylamidopropyl-N-methyl-N-carboxymethylammonium betaine; N,N-bis(stearamidopropyl)-N-methyl-N-carboxymethylammonium betaine; N-(stearamidopropyl)-N-dimethyl-N-carboxymethylammonium betaine; 3-(N-4-n-dodecylbenzyl-N,N-dimethylammonio)propane-1-sulfonate; and 3-(N-dodecylphenyl-N,N-dimethylammonio)-propane-1-sulfonate.

The surface-active agent is preferably present in the fabric care composition at a concentration of from about 5% to about 50%, preferably from about 10% to about 30%, and most preferably from about 15% to about 25%.

In the method of use aspect of the present invention the fabric care composition is added to an aqueous laundry washing or rinse medium to provide from about 50 ppm to about 500 ppm, preferably from about 150 ppm to about 350 ppm, most preferably from about 200 ppm to about 300 ppm, of starch on a solids basis. From about 30 ppm to about 400 ppm, preferably from about 50 ppm to about 300 ppm, and most preferably from about 100 ppm to 200 ppm of smectite clay is used. From about 200 ppm to about 4000 ppm of surface-active detergent, preferably from about 300 to about 2000, most preferably from about 500 to about 1500, is desirable in the aqueous laundry medium when the composition is to be used in the practice of U.S. Patent application Ser. No. 839,221, referred to hereinbefore.

Other ingredients can be included in minor amounts including optical brighteners, perfumes, anti-redeposition agents, detergency builder, suds suppressors, soil release agents, dyes, opacifiers, pigments, anti-bacterial agents, suds boosters, corrosion inhibitors, etc.

All percentages, parts and ratios herein are by weight unless otherwise specified.

EXAMPLE I 3.8%: Corn Products 3401 [CPC]

Prepared by slurrying starch, raising and maintaining a temperature of 170° F. for 10 minutes. Heat is removed and starch slurry exposed to 0.05% NaOH for two minutes, at which time excess alkali is neutralized with HCl. To this is added:

0.07%: NaCl (reaction product)

18.5%: Sodium $C_{12}$ linear alkyl benzene sulfonate 2.0%: Thixo-jel #2 (a colloidal sodium montmorillonite clay) [Georgia Kaolin Co.]

3.5%: Ethanol 8.0%: $Na_2CO_3$

Balance: $H_2O$

BROCK (a Na montmorillonite clay—Georgia Kaolin Co.) is substituted for Thixo-Jel #2. Substantially similar results are obtained.

EXAMPLE II 4.5% Amidex Starch B611 [CPC]

Prepared by slurrying starch under high shear while simultaneously exposing it to 0.75% KOH for 5 minutes, at which time the excess caustic is neutralized by the addition of the appropriate level of $H_2SO_4$.

2.33%: $K_2SO_4$ (reaction product)

3.5%: BROCK - Na montmorillonite clay [Georgia Kaolin Co.]

4.0%: Sodium bicarbonate 3.0%: $C_{12}$–$C_{13}$ linear alcohol, ethoxylated with an average of 6.5 ethylene oxide Balance: $H_2O$

EXAMPLE III 5.0% Fibersize—Oxidized Corn Starch [National Starch and Chemical]

Prepared by heating a slurry to 180° F. for 15 minutes after which 3.0% $K_2CO_3$ is added and agitated for 5 minutes. To this is added:

4.0%: Invite E [Na montmorillonite] [Industrial Mineral Ventures]

0.55%: Ditallow dimethyl ammonium chloride 15.0%: Magnesium neutralized, $C_{12}$ alkyl benzene sulfonate 4.0%: Ethanol 3.0%: Na Toluene sulfonate Balance: $H_2O$

EXAMPLE IV

15%: KOFILM 50 [ether modified starch] [National Starch and Chemical]

Prepared by heating to a slurry to 180° F. for 5 minutes. To this is added:

4.0%: Methyl, 1-stearylamidomethyl, 2-stearyl imidazolinium methosulfate

8%: Thixo jel #2 [Na montmorillonite] [Georgia Kaolin Co.]

8%: Ethanol
3% Na Cumene sulfonate
Balance: $H_2O$

EXAMPLE V

40%: Amidex B-511 (CPC)
30%: Thixo jel #2 [Georgia Kaolin]
5%: Ditallow dimethyl ammonium chloride
15%: $Na_2SO_4$
5%: $Na_2CO_3$
5%: Polyethylene glycol 6000

The ingredients are mixed in a blender to produce a granular product.

EXAMPLE VI

A mixed load of cotton and polyester garments soiled with dirty motor oil are placed in an automatic washing machine set on the wash-wear (100° F., 12 gal wash water) cycle. The contents of a bottle containing 300 ml of the following composition is added:

88% $C_{12-14}$ linear paraffin
12% sodium (bis) tridecyl sulfosuccinate after 4 minutes a bottle containing 300 ml of the following composition is added:

18% sodium $C_{12}$ alkyl benzene sulfonate
2% bentonite clay
4.5% gelatinized corn starch
remainder water The washing machine program is allowed to proceed through the remainder of the wash cycle and the rinse and extraction cycles. After line drying the fabrics are free of visible stains and have a crisp texture characteristic of dry cleaning.

The compositions of Examples I through V are added to aqueous media containing fabrics to provide a starch concentration of from about 50 ppm to about 500 ppm and a smectite clay concentration of from about 30 ppm to about 400 ppm. The fabrics are then subjected to a rinse in water, dried, and examined. Panelists grading the fabrics consider fabrics treated by the compositions to be crisp, to have body, and a soft surface. Starch without clay was reported to provide a stiffness or harshness; clay without starch was reported to provide a poorly acceptable limp fabric feel.

What is claimed is:

1. A fabric care composition comprising:
(a) from about 0.5% to about 75% of a smectite clay selected from the group consisting of alkali metal and alkaline earth metal montmorillonites, saponites, hectorites and mixtures thereof having an ion exchange capacity of at least about 50 meq. per 100 grams;
(b) from about 1% to about 90% of a gelatinized vegetable starch; and
(c) from 0% to about 98% water.

2. The composition of claim 1 wherein the composition is an aqueous dispersion comprising from about 0.5% to about 15% of smectite clay, from about 1% to about 15% of gelatinized vegetable starch, and from about 50% to about 98% water.

3. The composition of claim 2 which additionally comprises from about 10% to about 30% of a surface-active detergent selected from the group consisting of anionic, nonionic, zwitterionic and amphoteric surface-active detergents and mixtures thereof.

4. The compositions of claims 1, 2, or 3 which additionally comprise from about 0.25% to about 8% of a cationic quaternary ammonium anti-static and/or fabric softening agent.

5. The composition of claims 2 or 3 which comprise from about 1% to about 10% of smectite clay and from about 2% to about 10% gelatinized vegetable starch.

6. The composition of claim 2 wherein the starch is corn starch.

7. The composition of claims 2, 3 or 6 wherein the starch is stabilized by exposing a water dispersion of the gelatinized vegetable starch to a pH of from about 10 to about 13 to stabilize said starch and thereafter neutralizing any excess alkali to provide a pH of from about 4 to about 9.

8. The composition of claims 2, 3, or 6 wherein the starch is gelatinized by holding a water dispersion of said starch at a temperature above its gelatinization temperature for at least 5 minutes and stabilized by exposing said dispersion to a pH of from about 10 to about 13 during at least part of the gelatinization procedure and thereafter neutralizing any excess alkali to provide a pH of from about 4 to about 9.

9. An aqueous medium for providing fabric care benefits and restoring body to fabrics comprising from about 30 ppm to about 400 ppm of a smectite clay selected from the group consisting of alkali and alkaline earth metal montmorillonites, saponites, hectorites and mixtures thereof, having an ion exchange capacity of at least about 50 meq. per 100 grams and from about 50 ppm to about 500 ppm of a gelatinized vegetable starch.

10. A method of providing fabric care benefits and restoring body to fabrics comprising treating fabrics with the aqueous medium of claim 9, rinsing said fabrics and drying said fabrics.

* * * * *